US011351072B2

(12) United States Patent
Suvire Ante

(10) Patent No.: US 11,351,072 B2
(45) Date of Patent: Jun. 7, 2022

(54) FOLDABLE STRETCHER AND METHOD OF USING SAME

(71) Applicant: Alejandro Francisco Suvire Ante, Mendoza (AR)

(72) Inventor: Alejandro Francisco Suvire Ante, Mendoza (AR)

( * ) Notice: Subject to any disclaimer, the term of this patent is extended or adjusted under 35 U.S.C. 154(b) by 0 days.

(21) Appl. No.: 16/563,601

(22) Filed: Sep. 6, 2019

(65) Prior Publication Data

US 2021/0069036 A1 Mar. 11, 2021

(51) Int. Cl.
*A61G 1/013* (2006.01)
*A61G 1/003* (2006.01)

(52) U.S. Cl.
CPC ..... *A61G 1/013* (2013.01); *A61G 1/003* (2013.01)

(58) Field of Classification Search
CPC ..... A61G 1/013; A61G 1/00; A61G 1/003; A61G 1/02
See application file for complete search history.

(56) References Cited

U.S. PATENT DOCUMENTS 3,574,871 A * 4/1971 Greene ..... A61G 1/003 5/627
3,597,773 A * 8/1971 Firestone ..... A61G 1/003 5/627
4,480,345 A * 11/1984 Dunn ..... A61G 1/003 5/111
5,384,926 A * 1/1995 Al-Bargi ..... A61G 1/013 5/627
9,220,647 B1 * 12/2015 Steinbock ..... A61G 1/013
2004/0222617 A1 * 11/2004 Darling, III ..... A61G 1/0287 280/651
2009/0000035 A1 * 1/2009 Awerbuch ..... A61G 1/013 5/627
2011/0192942 A1 * 8/2011 Liu ..... A61G 1/013 248/166

(Continued)

FOREIGN PATENT DOCUMENTS

AR 100698 A1 10/2016
CN 207306802 U 5/2018

(Continued)

*Primary Examiner* — David R Hare
*Assistant Examiner* — George Sun
(74) *Attorney, Agent, or Firm* — Carter, Deluca & Farrell LLP

(57) ABSTRACT

A stretcher may include a foldable/decomposable frame. The frame may include at least two transverse frame elements and two longitudinal frame elements. Each of the longitudinal frame elements may include at least a first longitudinal member and at least a second longitudinal member that may be perpendicularly connectable at their respective first ends to the opposite transverse frame elements and may be removably connectable to each other at their second ends. The stretcher may include multiple support assemblies. Each of the multiple support assemblies may include an elongated support and two support connectors. The support connectors of each of the multiple support assemblies may be removably connectable at their first ends to the opposite longitudinal frame elements and removably connectable at their seconds ends to opposite ends of the respective elongated support.

12 Claims, 16 Drawing Sheets

(56) References Cited

U.S. PATENT DOCUMENTS

| | | | | |
|---|---|---|---|---|
| 2013/0086748 | A1* | 4/2013 | Walter | A61G 1/013 5/627 |
| 2013/0239332 | A1* | 9/2013 | Pringle-Parker | A61G 1/013 5/628 |
| 2015/0052682 | A1* | 2/2015 | Biswell | A61G 1/013 5/627 |
| 2016/0158076 | A1* | 6/2016 | Hobbs | A61G 7/1051 5/627 |
| 2016/0242973 | A1* | 8/2016 | Delaney | A61G 1/01 |
| 2016/0331605 | A1* | 11/2016 | Warren | A61G 1/052 |
| 2016/0338894 | A1* | 11/2016 | Rodriguez | A61G 7/1063 |
| 2017/0128288 | A1* | 5/2017 | Sion | A61G 1/044 |

FOREIGN PATENT DOCUMENTS

| | | | |
|---|---|---|---|
| RU | 2557736 | C1 | 7/2015 |
| WO | 2021042224 | A1 | 3/2021 |

* cited by examiner

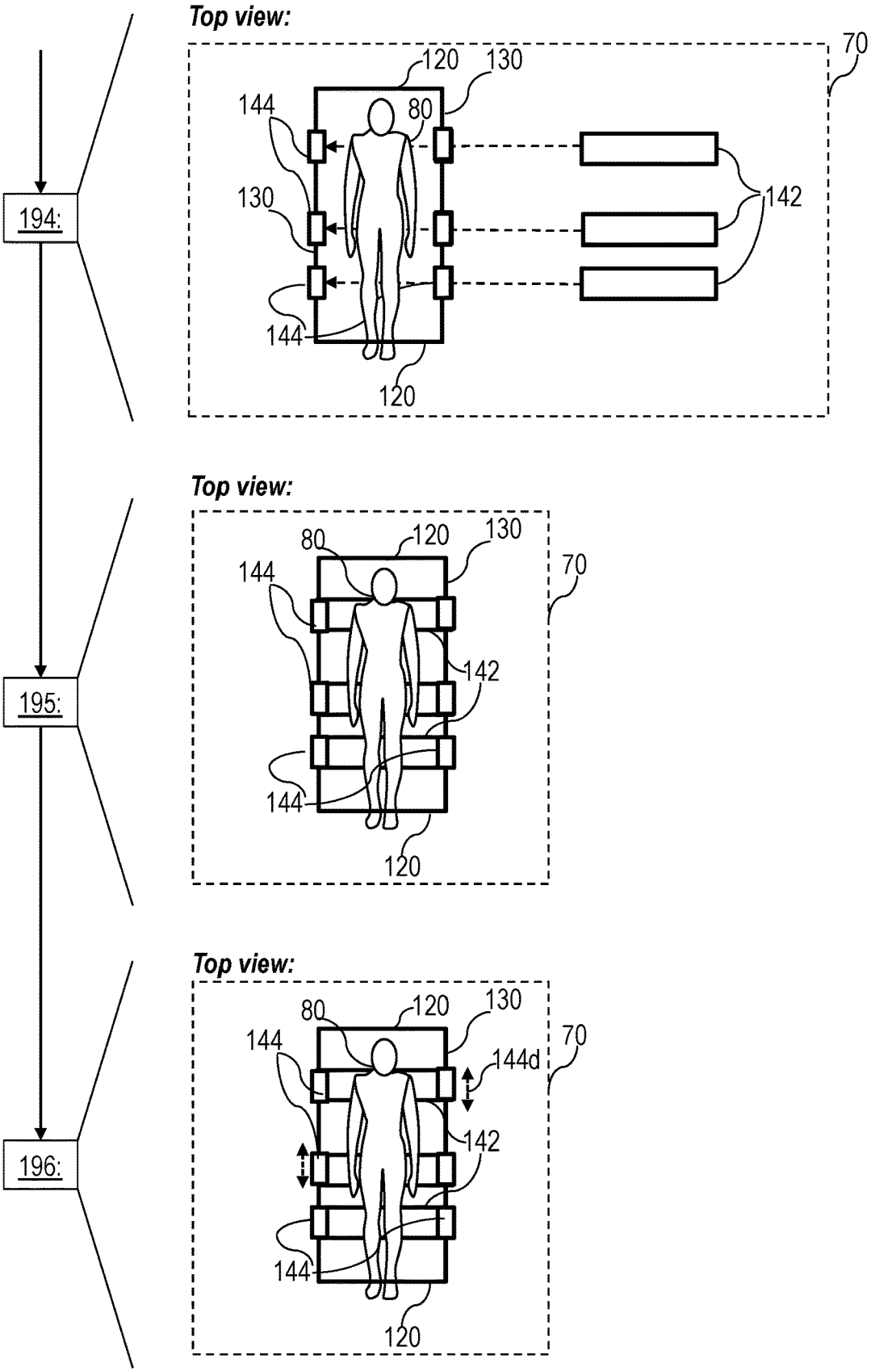
*Fig. 1I (cont. 1)*

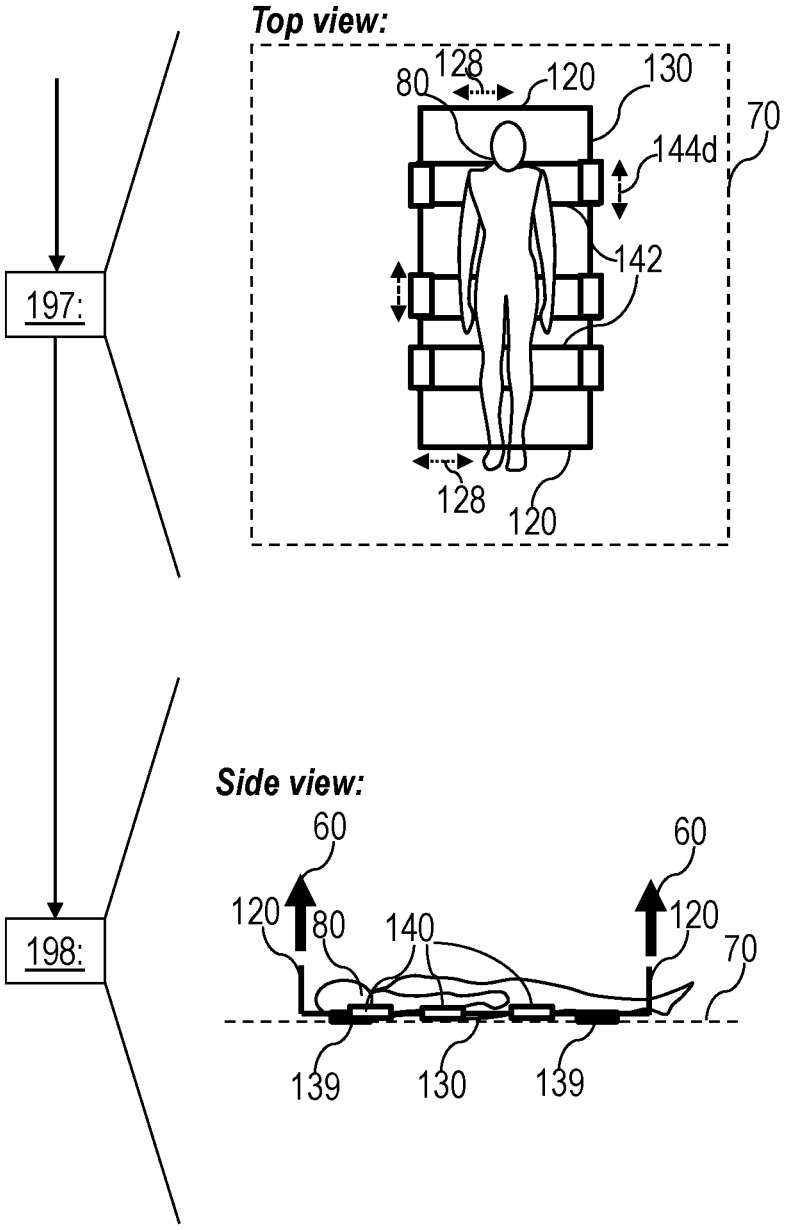
*Fig. 1l (cont. 2)*

210

*Front view:*

210

*Top view:*

310

*Front view:*

310

*Top view:*

FOLDABLE STRETCHER AND METHOD OF USING SAME

FIELD OF THE INVENTION

The present invention relates to the field of stretchers, and more particularly, to foldable stretchers.

BACKGROUND OF THE INVENTION

Current stretchers typically require a physical contact between one or more users and an injured subject in order to load/unload the injured subject on/from the stretcher. Such physical contact may worsen the condition of the injured subject and/or may cause another injury to the injured subject. Furthermore, some current foldable stretchers are typically bulky even in their folded state.

Accordingly, there is a long-felt need in a stretcher that enables loading/unloading of an injured subject without a physical contact between the user(s) and the injured subject, that is foldable in a quick and compact way and that it may be widened or narrowed (in case of need) without having to remove the injured subject from the stretcher.

SUMMARY OF THE INVENTION

One aspect of the present invention may provide a stretcher, the stretcher including a foldable/decomposable frame including: two transverse frame elements, and two longitudinal frame elements each including at least a first longitudinal member and at least a second longitudinal member perpendicularly connectable at their respective first ends to the opposite transverse frame elements and removably connectable to each other at their second ends; and multiple support assemblies, each including: an elongated support, and two support connectors removably connectable at their first ends to the opposite longitudinal frame elements and removably connectable at their seconds ends to opposite ends of the elongated support.

In some embodiments, each of the longitudinal frame elements may include at least a third longitudinal member removably connectable at its first end to the second of the respective first longitudinal member and removably connectable at its second end to the second end of the respective second longitudinal member.

In some embodiments, the first longitudinal member and the second longitudinal member are removably connectable at their first ends to the opposite transverse frame elements.

In some embodiments, each of the transverse frame elements may include: a first transverse member, and a second transverse member, wherein the first transverse member is adapted to tightly and movably receive the respective second transverse member and to enable movement of the second transverse member within the first transverse member when a desired force is applied thereto to thereby adjust a length of the transverse frame element.

In some embodiments, at least one of the transverse frame elements may include two bars, each perpendicularly protruding from one of the ends of the respective transverse frame element.

In some embodiments, the at least one transverse frame element is aligned at a predetermined transverse frame element angle with respect to a plane defined by the longitudinal frame elements when the frame is in its unfolded/assembled state, wherein the predetermined transverse frame element angle ranges between 0° and 90°.

In some embodiments, each of the support connectors of each of the support assemblies may include a first end and a second end, wherein the first end is curved towards the second end at a first radius of curvature, and wherein the second end is curved towards the first end at a second radius of curvature and along a same lateral side of the support connector, and the elongated support of each of the support assemblies may include apertures at its opposite ends, each of the apertures being adapted to receive the second end of one of the support connectors of the respective support assembly.

In some embodiments, the first radius of curvature is determined based on a radius of the longitudinal elements to enable at least one of: a tight and removable connection of the first end of each of the support connectors of each of the support assemblies to the longitudinal frame elements; rotation of the first end of each of the support connectors of each of the support assemblies about the longitudinal frame elements; and movement of the first end of each of the support connectors of each of the support assemblies along the longitudinal frame elements.

In some embodiments, at least one of the first longitudinal member and at the second longitudinal member of each of the longitudinal frame elements may include at least one leg, wherein the legs are dimensioned to elevate the frame above a surface by a predetermined height when the frame is in its unfolded/assembled state and the frame is disposed on the surface.

In some embodiments, the stretcher may further include a secure band and wherein each of the support connectors of at least one of the support assemblies may include a secure band connector at the respective first end, the secure band connector is adapted to removably connect the secure band to the respective support connector.

Another aspect of the present invention may provide a method of loading a lying person onto a stretcher, the stretcher including at least two transverse frame elements, at least two longitudinal frame elements and multiple support assemblies, each comprising an elongated support and two support connectors, the method including: assembling at least some of the at least two transverse frame elements and the at least two longitudinal frame elements to form a substantially rectangular frame; placing the frame to surround at least a portion of the lying person substantially without touching or interfering with the lying person; connecting each of the support connectors of each of at least some of the multiple support assemblies to one of the at least two longitudinal frame elements; threading the support element of each of the at least some of the multiple support assemblies between the lying person and a surface substantially without touching or interfering with the lying person; connecting the support element of each of the at least some of the multiple support assemblies to the at least two longitudinal frame elements using the respective support connectors; and lifting the frame with the lying person supported by the at least some of the multiple support assemblies.

In some embodiments, the method may include adjusting a location of the support connectors and of the respective support element of at least one of the at least some of the multiple support assemblies along the at least two longitudinal frame elements, prior to lifting the frame.

In some embodiments, the method may include adjusting a length of the at least two transverse elements to adjust a width of the frame, prior to lifting the frame.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same can be carried into effect, reference will now be made, purely by way of example, to the accompanying drawings in which like numerals designate corresponding elements or sections throughout.

In the accompanying drawings.

Figure 1A:
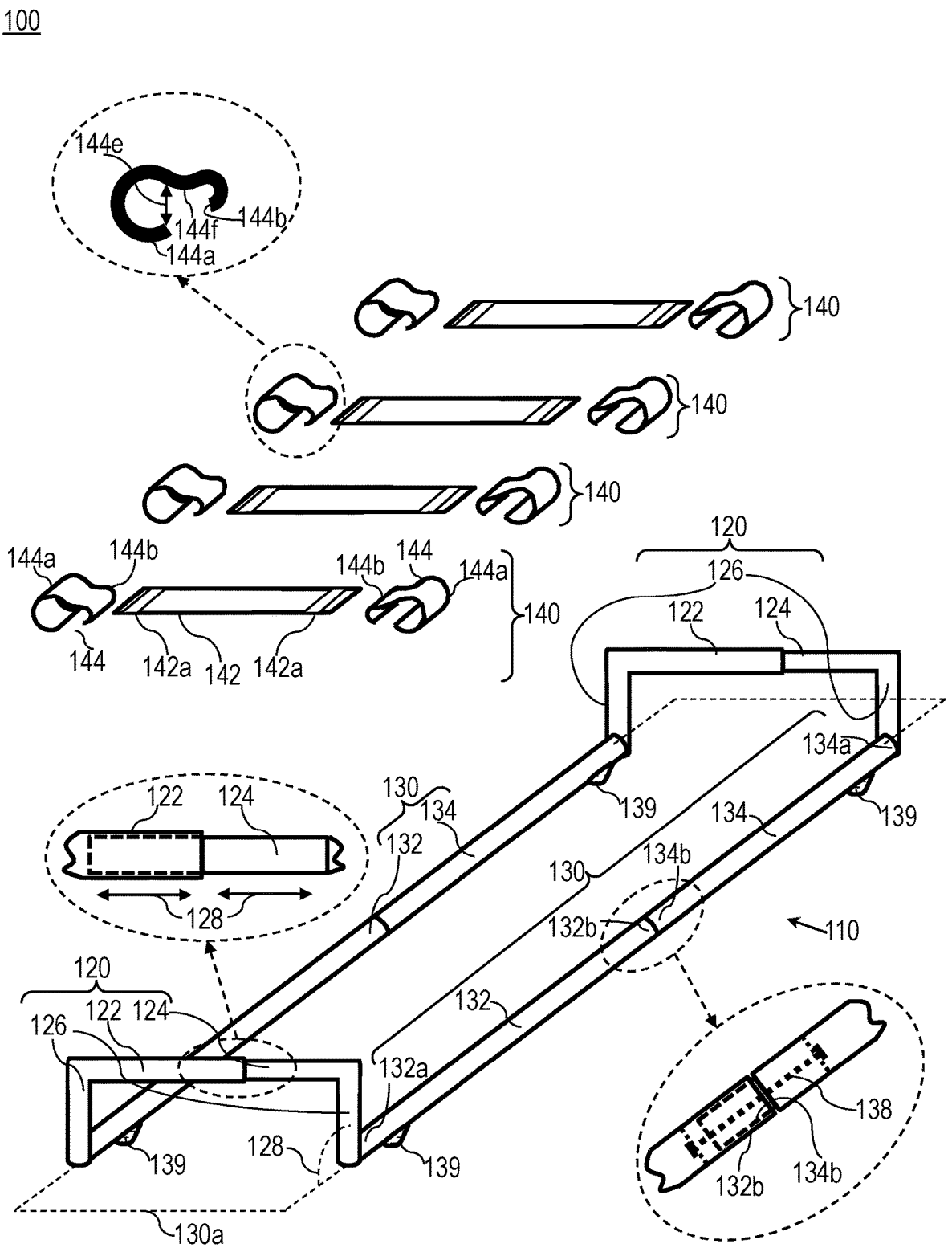
FIG. 1A is a schematic illustration of a stretcher, according to some embodiments of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

Some aspects of the present invention provide a stretcher. The stretcher may include a foldable/decomposable frame. The frame may include two transverse frame elements and two longitudinal frame elements that are perpendicular (or substantially perpendicular) to the transverse frame elements when the frame is in its unfolded/assembled state. Each of the longitudinal frame elements may include at least a first longitudinal member and at least a second longitudinal member. The first longitudinal member and the second longitudinal member of each of the longitudinal frame elements may be connected, or removably connectable, at their first ends to the opposite transverse frame elements and may be tightly and removably connectable to each other at their second ends. The first longitudinal member and the second longitudinal member of each of the longitudinal frame elements may be disconnected from each other to thereby fold/disassemble the frame or may be connected to each other to thereby unfold/assemble the frame.

The stretcher may include multiple support assemblies. Each of the support assemblies may include an elongated support and two support connectors. The support connectors of each of the support assemblies may be removably connectable at their first ends to the opposite longitudinal frame elements of the frame and removably connectable at their second ends to opposite ends of the respective elongated support.

In operation, the stretcher may enable loading/unloading of an injured subject onto/from the stretcher without a physical contact between one or more users and the injured subject. For example, when an injured subject lies on a surface, the frame of the stretch may be unfolded/assembled and placed on the surface to surround at least a portion of the injured subject. The elongated supports may then be threaded between the injured subject and the surface (e.g., through gaps formed between the injured subject and the surface, for example, beneath knees, low back, neck, etc.), thus forming a fastening base of the stretcher. The elongated supports may then be connected to the longitudinal frame elements using the support connectors. The position of the support connectors along the longitudinal frame elements (and thus the position of the elongated supports along the frame) may be adjusted to provide a desired support to the injured subject. The stretcher with the injured subject lying thereon may then be lifted, for example by two or more users, and moved to a target location. When arrived at the target location, the stretcher may be placed on a surface such as, for example, a hospital bed. The elongated supports may be then disconnected from the support connectors and pulled from beneath the injured subject. The support connectors may be then disconnected from the longitudinal frame elements, and the frame may be folded/disassembled.

Reference is now made to FIG. 1A, which is a schematic illustration of a stretcher 100, according to some embodiments of the invention.

Figure 1B:
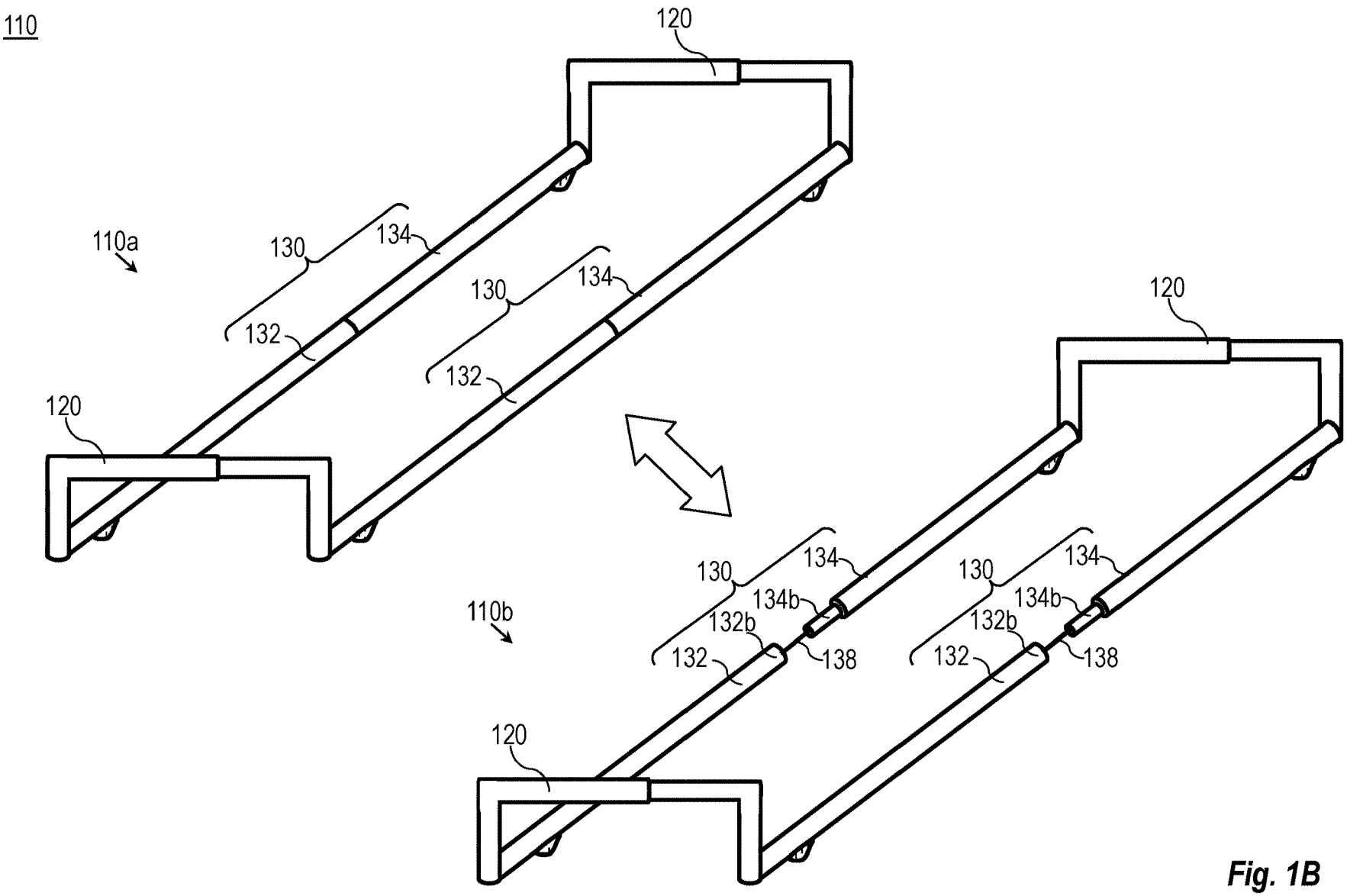
FIGS. 1B, 1C and 1D are schematic illustrations of various configurations of a frame 110 of a stretcher in an unfolded/assembled state and a folded/disassembled state, according to some embodiments of the invention.
Figure 1C:
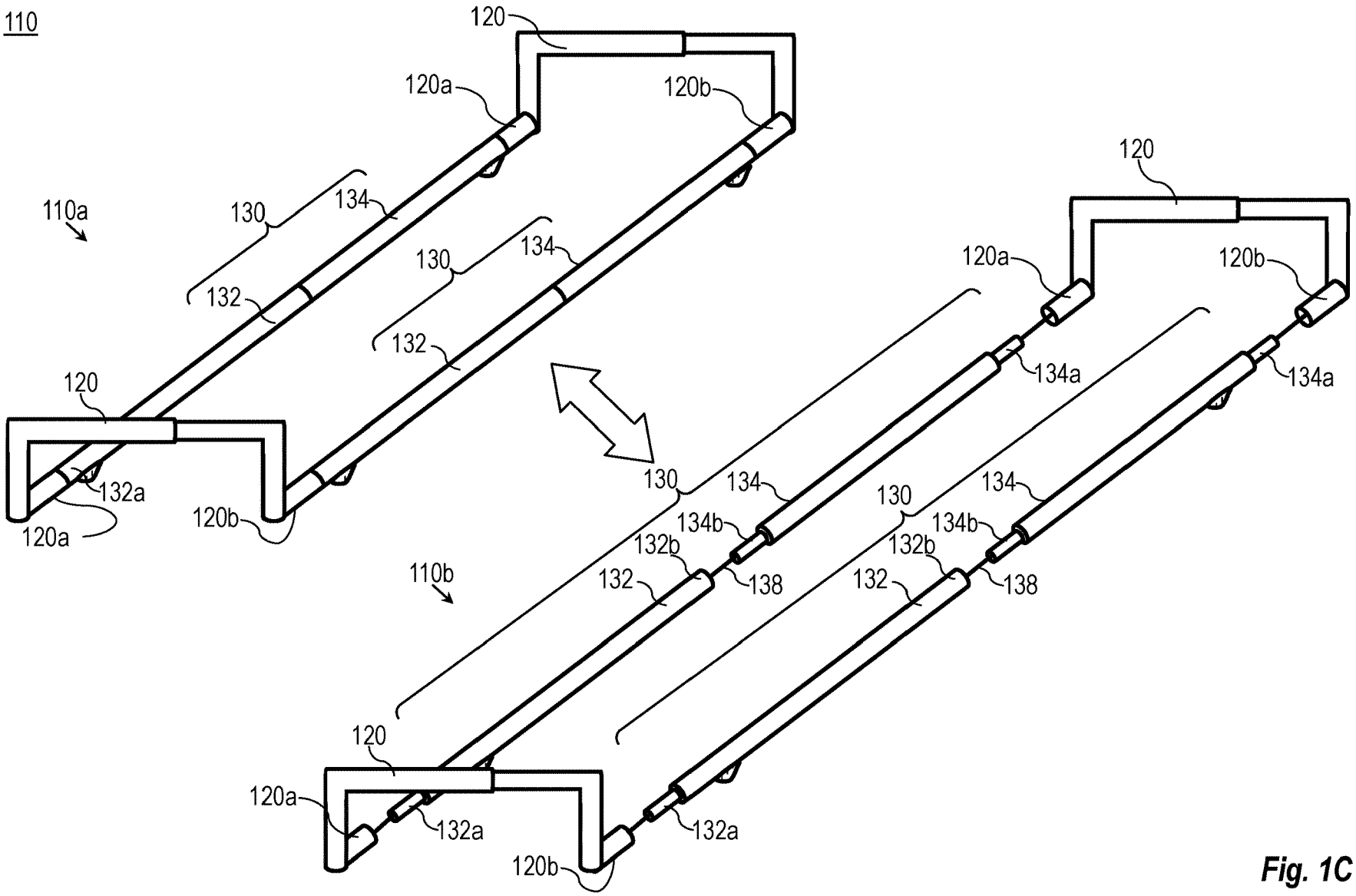
Figure 1D:
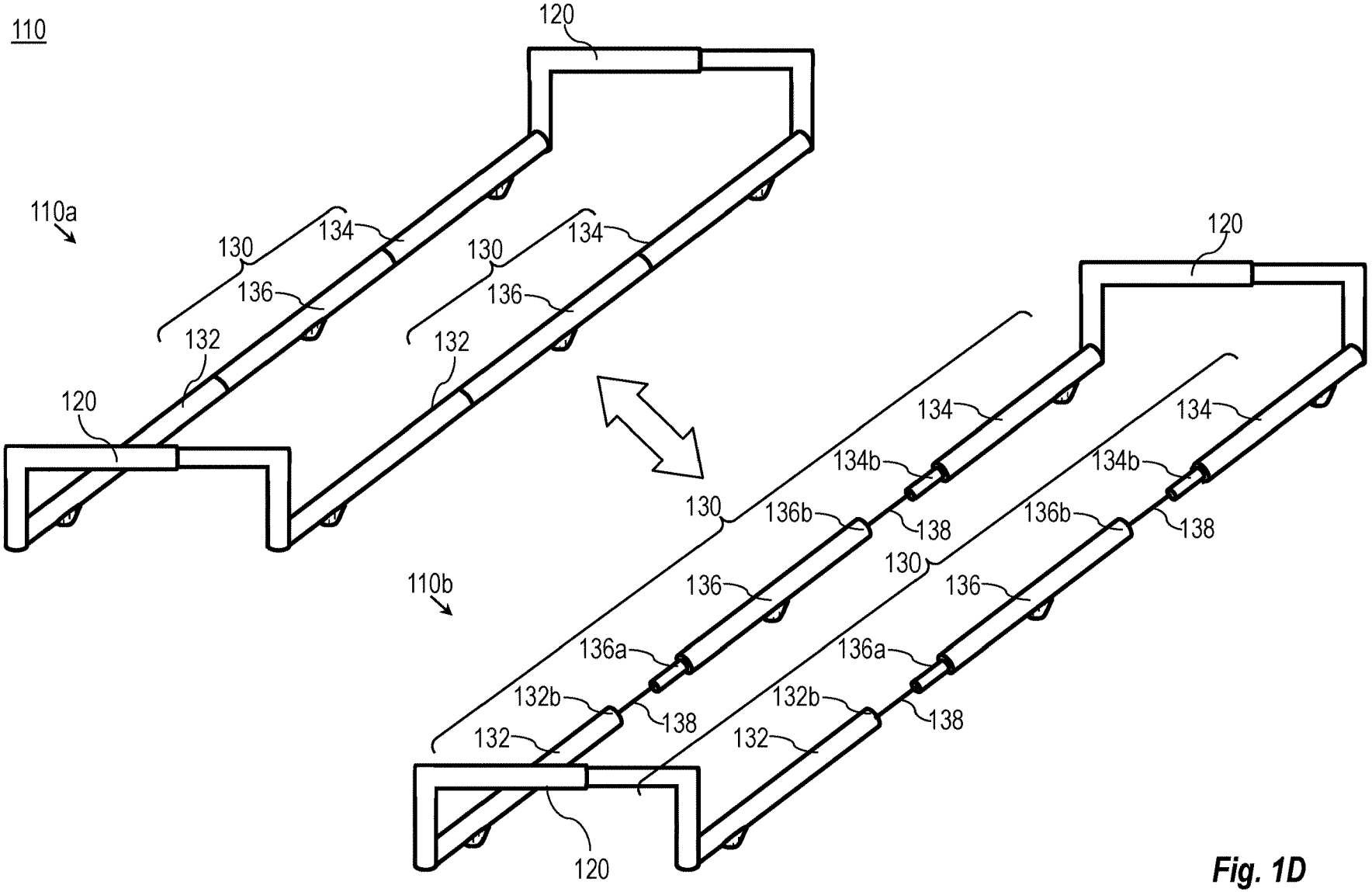

Reference is also made to FIGS. 1B, 1C and 1D, which are schematic illustrations of various configurations of a frame 110 of a stretcher 100 in an unfolded/assembled state and a folded/disassembled state, according to some embodiments of the invention.

Figure 1E:
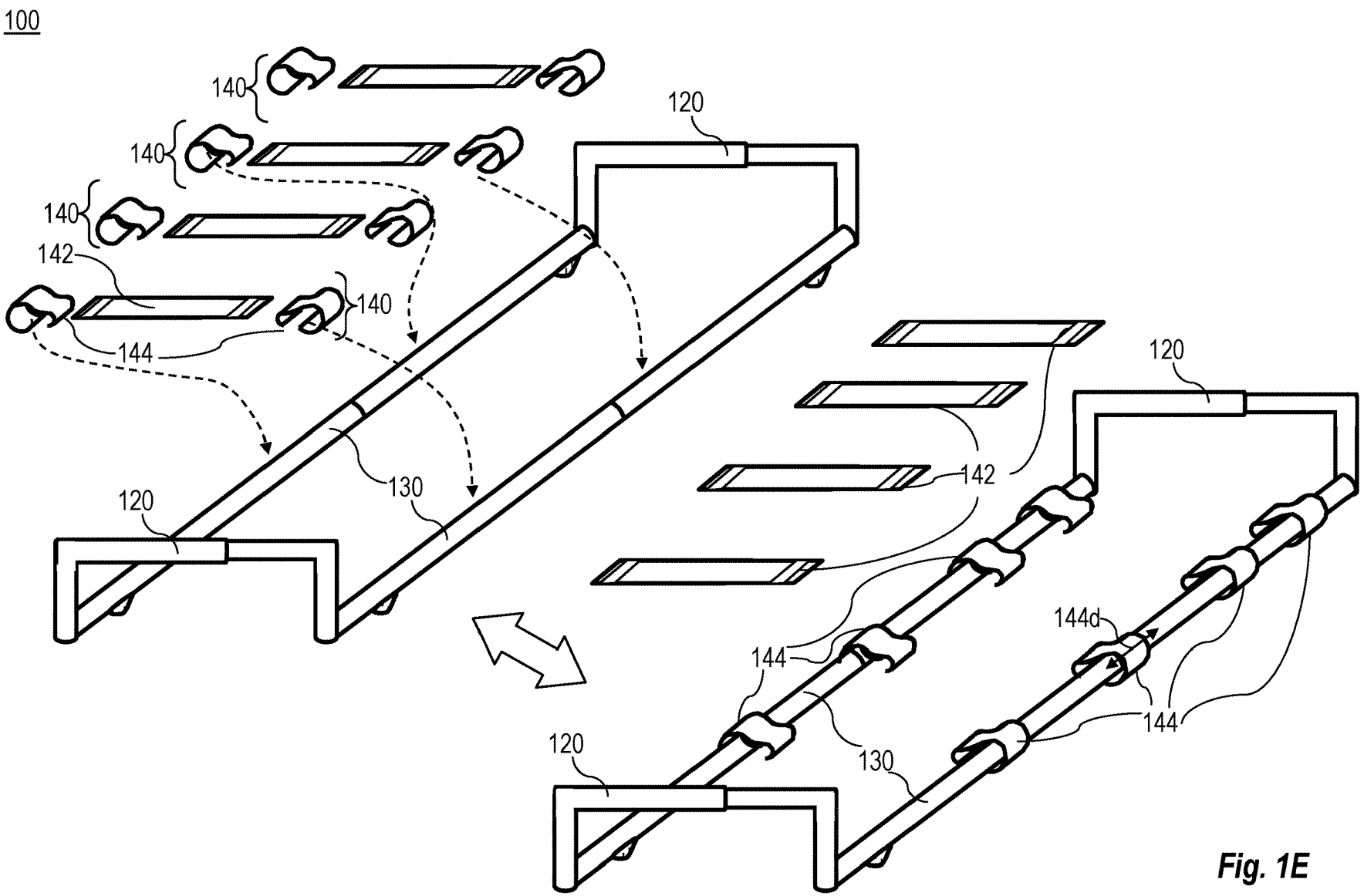
FIGS. 1E and 1F are schematic illustrations of a process of connection of support assemblies to a frame of a stretcher, according to some embodiments of the invention.
Figure 1F:
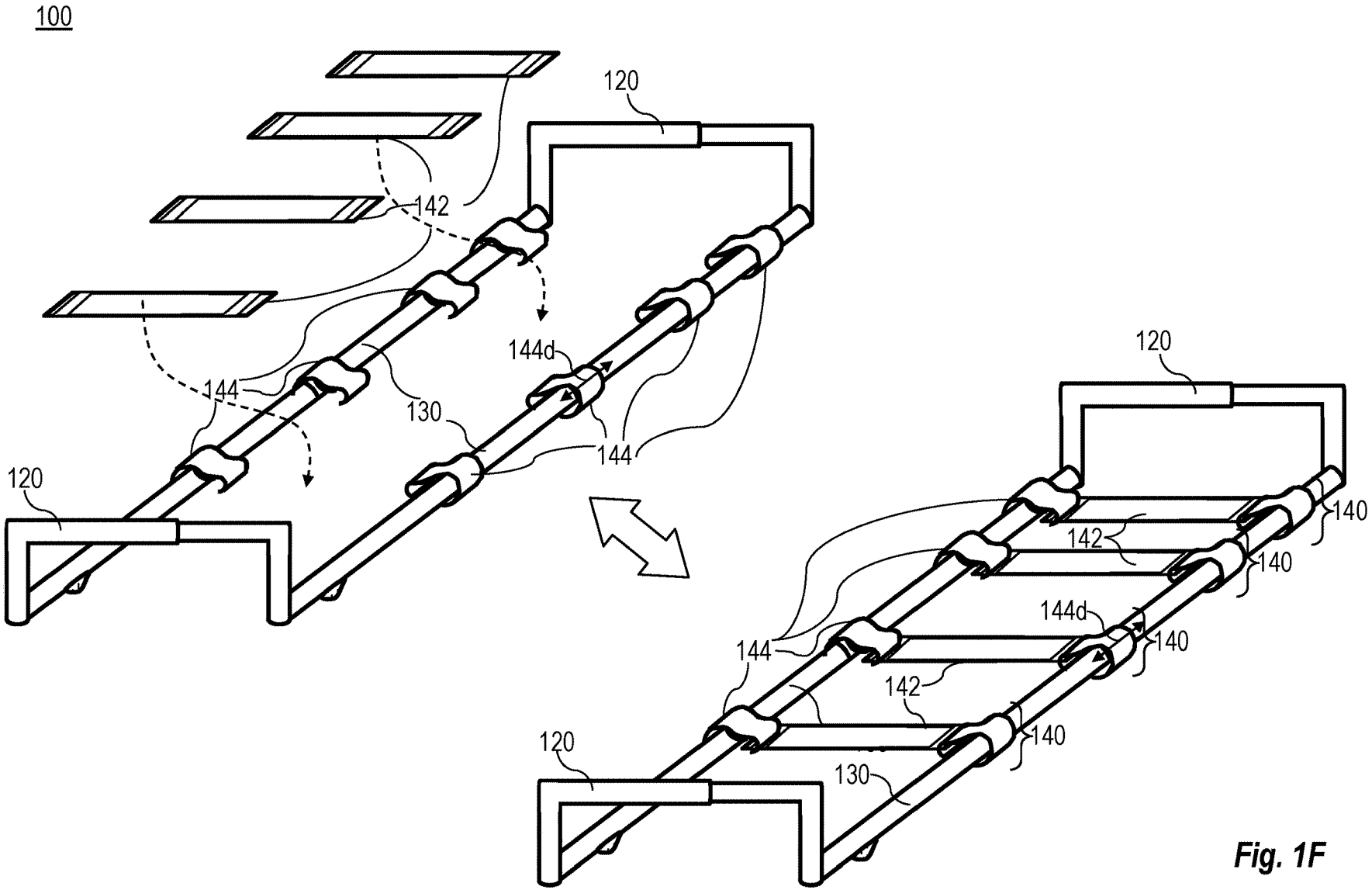

Reference is also made to FIGS. 1E and 1F, which are schematic illustrations of a process of connection of support assemblies 140 to a frame 110 of a stretcher 100, according to some embodiments of the invention.

Figure 1G:
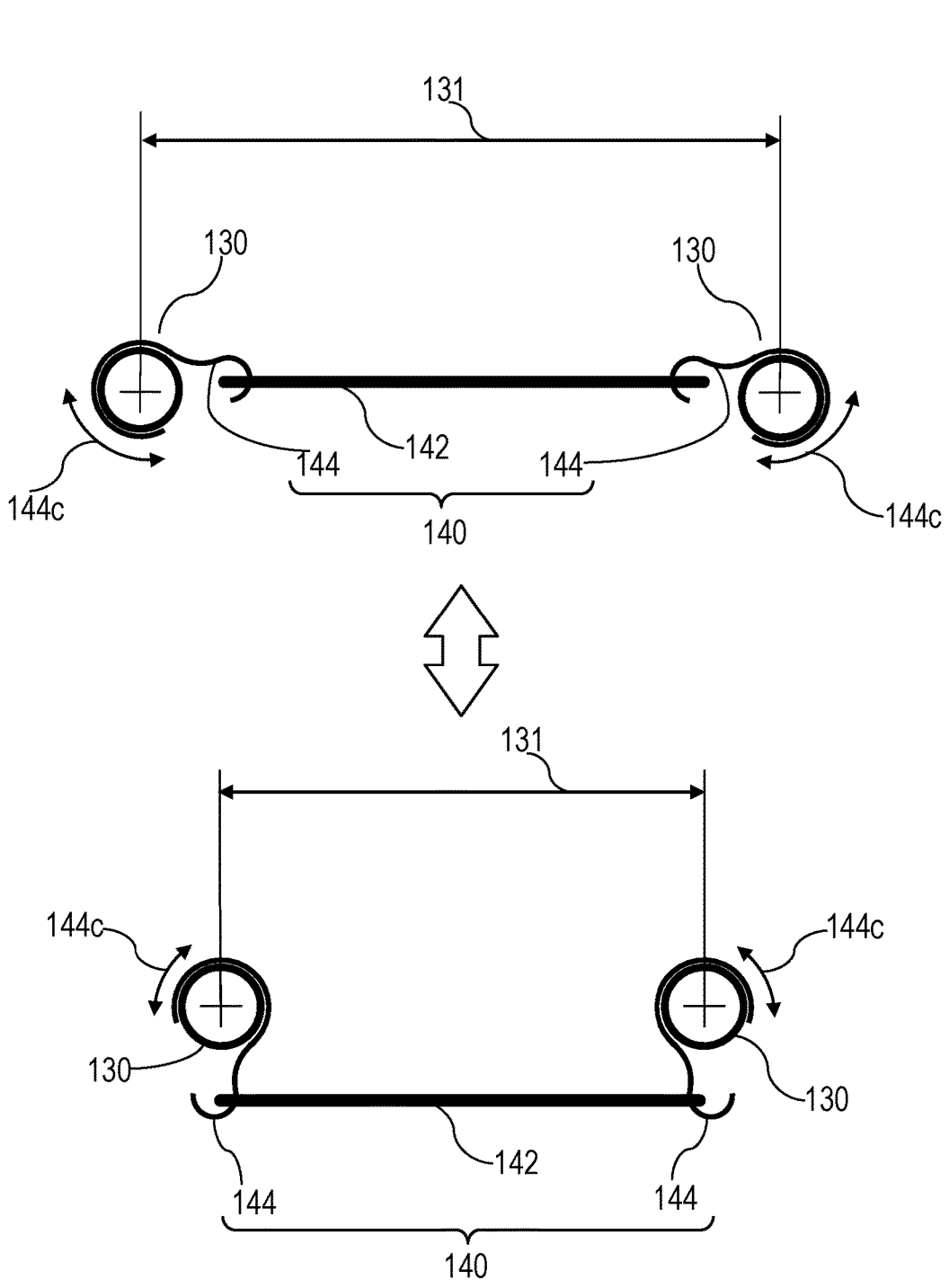
FIG. 1G illustrates a capability of a stretcher to adjust a distance between longitudinal frame elements of a frame thereof, according to some embodiments of the invention.

Reference is also made to FIG. 1G, which illustrates a capability of a stretcher 100 to adjust a distance between longitudinal frame elements 130 of a frame 110 thereof, according to some embodiments of the invention.

Reference is also made to FIG. 111, which is a schematic illustration of a stretcher 100 including a secure band 150, according to some embodiments of the invention.

According to some embodiments, stretcher 100 may include a foldable/decomposable frame 110. Frame 110 may include two transverse frame elements 120 and two longitudinal frame elements 130. Longitudinal frame elements 130 may be perpendicular (or substantially perpendicular) to transverse frame elements 120 when frame 110 is in unfolded/assembled state, thereby forming a rectangular (or substantially rectangular) frame 110. In some embodiments, transverse frame elements 120 and longitudinal frame elements 130 may be tubular elements (e.g., as shown in FIGS. 1A, 1B, 1C, 1D, 1E, 1F, 1G and 1H).

In some embodiments, each of longitudinal frame elements 130 may include at least a first longitudinal member 132 and at least a second longitudinal member 134. For example, frame element 130 may include three longitudinal members 132, 134, 13X (not shown in FIG. 1A). First longitudinal member 132 and second longitudinal member 134 of each of longitudinal frame elements 130 may be connected, or removably connectable, at their first ends 132*a*, 134*a*, respectively, to opposite transverse frame elements 120 and may be tightly and removably connectable to each other at their second ends 132*b*, 134*b*, respectively (e.g., as shown in FIGS. 1A, 1B and 1C).

In embodiments shown in FIGS. 1A, 1B, 1C and 1D, second end 132*b* of first longitudinal member 132 of each of longitudinal frame elements 130 may be adapted (e.g., in shape and size) to tightly and removably receive second end 134*b* of respective second longitudinal member 134. It is noted that other types of connections between first longitudinal member 132 and second longitudinal member 134 may be used as well.

In some embodiments, second end 132*b* of first longitudinal member 132 of each of longitudinal frame elements 130 may be connected to second end 134*b* of respective second longitudinal member 134 by a rope 138 (e.g., as shown in FIGS. 1A, 1B, 1C and 1D). Rope 138 may be made of, for example, flexible and/or extendable material.

In some embodiments, each of longitudinal frame elements 130 may include at least a third longitudinal member 136 (e.g., as shown in FIG. 1D). In embodiments shown in FIG. 1D, second end 132*b* of first longitudinal member 132 of each of longitudinal frame elements 130 may be adapted (e.g., in shape and size) to tightly and removably receive a first end 136*a* of respective third longitudinal member 136, and a second end 136*b* of respective third longitudinal member 136 may be adapted (e.g., in shape and size) to tightly and removably receive second end 134*b* of respective second longitudinal member 134. It is noted that each of longitudinal frame elements 130 may include other number of longitudinal members as well.

In various embodiments, second end 132*a* of first longitudinal member 132 of each of longitudinal frame elements 130 and second end 134*b* and first end 136*a* of respective third longitudinal member 136 and/or second end 136*b* of respective third longitudinal member 136 and second end 134*b* of respective second longitudinal member 134 may be connected by ropes 138 (e.g., as shown in FIG. 1D).

First longitudinal member 132, second longitudinal member 134, and optionally third longitudinal member 136 of each of longitudinal frame elements 130 may be disconnected from each other (e.g., as shown in illustrations 110*b* in FIGS. 1B, 1C and 1D) to enable folding/disassembling frame 110. First longitudinal member 132, second longitudinal member 134, and optionally third longitudinal member 136 of each of longitudinal frame elements 130 may be connected to each other (e.g., as shown in illustrations 110*a* in FIGS. 1B, 1C and 1D) to enable unfolding/assembling frame 110.

In some embodiments, transverse frame elements 120 may be capable of extending and retracting in length. In embodiments shown in FIGS. 1A, 1B, 1C, 1D, 1E, 1F, 1G and 1H, each of transverse frame elements 120 may include a first transverse member 122 and a second transverse member 124. First transverse member 122 of each of transverse frame elements 120 may be adapted (e.g., is shape and size) to tightly and movably receive respective second transverse member 124 and to enable movement of second transverse member 124 within first transverse member 122 when a desired force is applied to the members thereof (e.g., as indicated by arrow 128 in FIG. 1A), e.g., in a telescoping arrangement. Extendable/retractable transverse frame elements 120 may enable adjustment of a distance between longitudinal frame elements 130 even when frame 110 is in its unfolded/assembled state and/or when accommodating an injured subject.

In some embodiments, at least one of transverse frame elements 120 may include two bars 126, wherein each of bars 126 may perpendicularly protrude from one of ends of respective transverse frame elements 120. In some embodiments, transverse elements may be aligned at a predetermined transverse frame element angle 128 with respect to a plane 130*a* defined by longitudinal frame elements 130 (e.g., as shown in FIG. 1A). Transverse frame elements angle 128 may range between, for example, 0° and 90°. For example, in embodiments shown in FIGS. 1A-1F and 1H, transverse frame elements are aligned at 90° with respect to plane 130*a*.

In some embodiments, longitudinal frame elements 130 may be removably connectable to transverse frame elements 120. In embodiments shown in FIG. 1C, ends 120*a*, 120*b* of one of transverse frame elements 120 may be each adapted (e.g., is shape and size) to tightly and removably receive first end 132*a* of first longitudinal member 132 of one of first longitudinal frame elements 130, and ends 120*a*, 120*b* of another of transverse frame elements 120 may be each adapted (e.g., is shape and size) to tightly and removably receive first end 134*a* of second longitudinal member 134 of one of first longitudinal frame elements 130. The ends 120*a*, 120*b* of transverse frame elements 120 and first ends 132*a*, 134*a* of first longitudinal member 132 and second longitudinal member 132 may be connected using ropes 138 (e.g., as shown in FIG. 1C).

In various embodiments, at least one of first longitudinal member 132, second longitudinal member 134, and optionally third longitudinal member 136 of each of longitudinal frame elements 130 may include at least one leg 139 (e.g., as shown in FIGS. 1A-1F and 1H). Leg(s) 139 may be adapted to elevate frame 110 above a surface when stretcher 100 is positioned thereon.

Figure 1H:
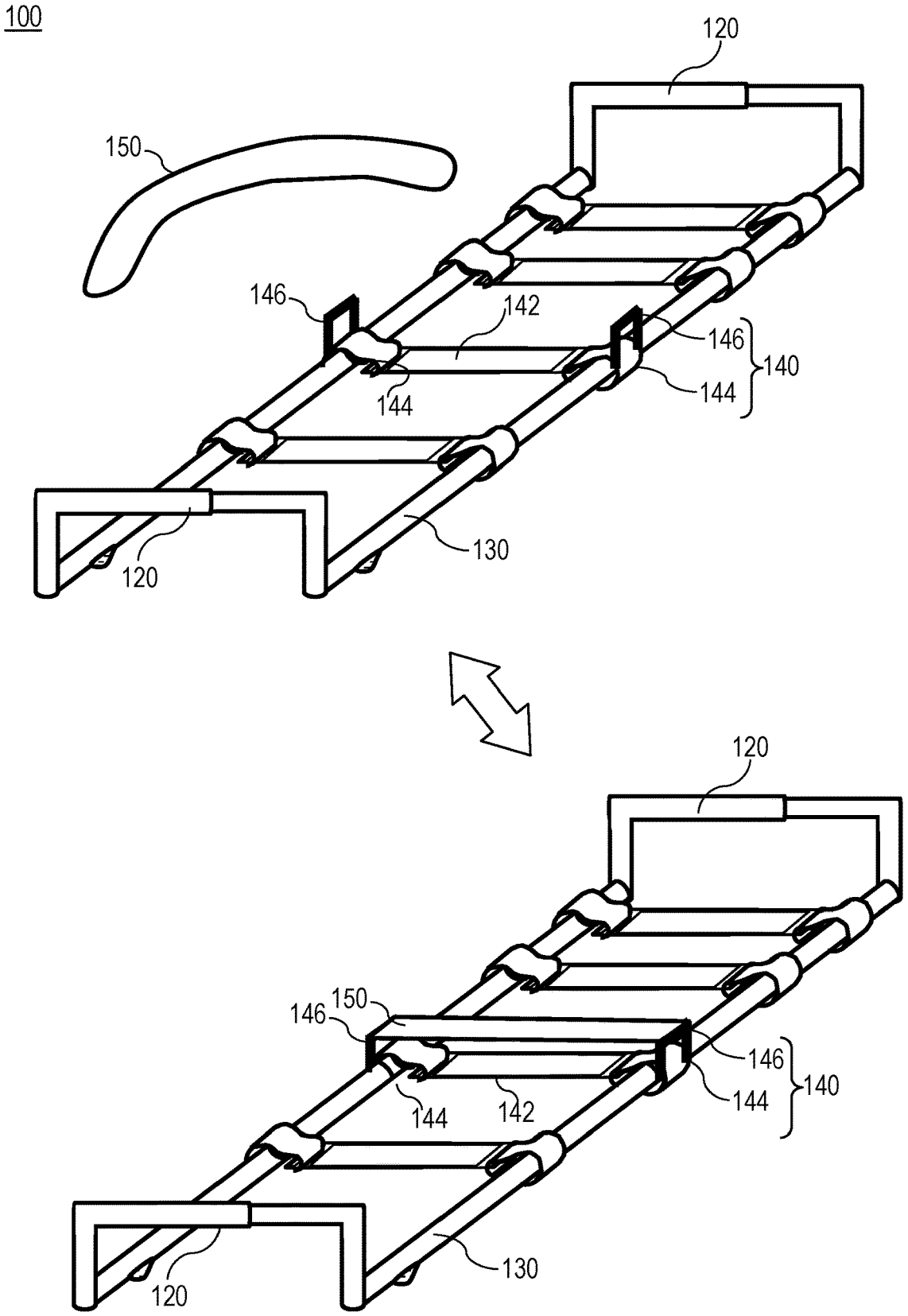
FIG. 1H is a schematic illustration of a stretcher including a secure band, according to some embodiments of the invention.
Figure 1L:
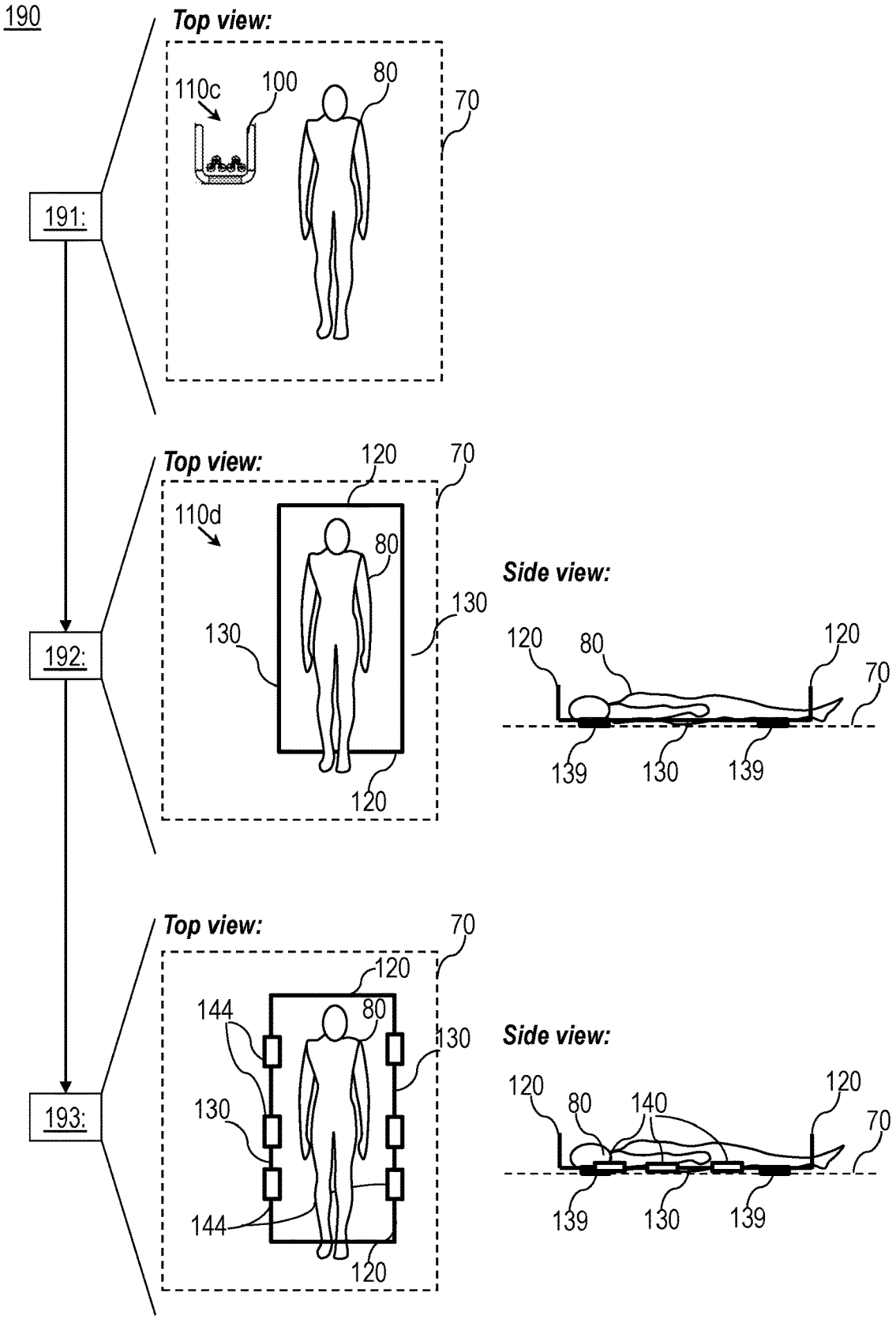
FIG. 1I shows an example of a procedure of operating a stretcher, according to some embodiments of the invention.

According to some embodiments, stretcher 100 may include multiple support assemblies 140. In some embodiments, stretcher 100 may include 3-9 support assemblies 140. For example, FIGS. 1E, 1F and 1H show stretcher 100 with 4 support assemblies. It is noted that stretcher 100 may include other number of support assemblies 140 as well.

Each of multiple support assemblies 140 may include an elongated support 142 and two support connectors 144. Support connectors 144 of each of support assemblies 140 may be removably connectable at their first ends 144*a* to opposite longitudinal frames 130 and at their second ends 144*b* to respective elongated support 142 (e.g., as shown in FIGS. 1E and 1F).

In embodiments shown in FIGS. 1E, 1F, 1G, 1H, a first end 144*a* of each of support connectors 144 may be curved towards a second end 144*b* of respective support connector 144 at a first radius of curvature, such that a gap 144*e* is formed between first end 144*a* and a lateral surface 144*f* of respective support connector 144. The first radius of curvature and/or dimensions of gap 144*e* may be determined based on a radius/diameter of longitudinal frame elements 130 to enable tight and removable connection of first ends 144*a* of support connectors 144 to longitudinal frame elements 130.

In embodiments shown in FIGS. 1E, 1F, 1G, 1H, second end 144*b* of each of support connectors 144 may be curved towards first end 144*a* of respective support connector 144 at a second radius of curvature. In some embodiments, first end 144*a* and second ends 144*b* of each of support connectors 144 may be curved towards each other along the same lateral surface 144*f* of respective support connector 144. In some embodiments, the second radius of curvature may be smaller than the first radius of curvature of first end 144*a* of support connectors 144.

In embodiments shown in FIG. 1E, 1F, 1G, 1H, elongated support connector 142 of each of support assemblies 140 may include apertures 142*a* at its opposite ends. Apertures 142*a* may be adapted (e.g., in shape and size) to receive second ends 144*b* of support connectors 144 of respective of support assembly 140.

The first radius of curvature of first ends 144*a* of support connectors 144 may be further determined to enable rotation of the support connectors 144 about longitudinal frame elements 130 (e.g., as indicated by arrows 144*c* in FIG. 1G). In this manner, the length of transverse elements 120 and, as a result, a distance 131 between longitudinal frame elements 130 may be adjusted (e.g., by extending/retracting transverse elements 120) even when elongated supports 142 of support assemblies 140 are connected to longitudinal frame elements 130 by respective support connectors 144 (e.g., as shown in FIG. 1G).

The first radius of curvature of first ends 144*a* of support connectors 144 may be further determined to enable movement of the support connectors 144 along longitudinal frame elements 130 (e.g., as indicated by arrow 144*d* in FIGS. 1E, 1F). In this manner, the location of support connectors 144 and thus the location of elongated supports 142 along longitudinal frame elements may be adjusted.

In some embodiments, stretcher 100 may include a secure band 150 (e.g., as shown in FIG. 1H). In some embodiments, support connectors 144 of at least one of support assemblies 140 may each include a secure band connector 146 at its respective first end 144*a*. Secure band connector 146 may be adapted to removably connect secure band 150 to respective support connectors 144. Secure band 150 may secure an injured subject to stretcher 100 when positioned thereon. In embodiments shown in FIG. 1H, support connectors 146 have a substantially rectangular shape that are tangent to first ends 144*a* of support connectors 144.

Reference is now made to FIG. 1I, which shows an example of a procedure 190 of operating a stretcher 100, according to some embodiments of the invention.

It is noted that procedure 190 is not limited to a flowchart, illustrations in FIG. 1I and to the corresponding description. For example, in various embodiments, procedure 190 need not move through each illustrated stage, or in exactly the same order as illustrated and described.

In operation, stretcher 100 may enable loading/unloading of a subject 80, and specifically an injured subject, on/from stretcher 100 without a physical contact between the one or more users and the injured subject 80. Stretcher 100 may also enable assembling thereof around and under the subject without interfering with the subject.

For example, injured subject 80 lies on a surface 70 in an accident site. At stage 191, stretcher 100 may be brought to the accident site. At this stage, frame 110 of stretcher 100 may be in its folded/disassembled state 110*c*, and support assemblies 140 may be disconnected from frame 110.

At stage 192, frame 110 may be unfolded/assembled into its unfolded/assembled state 110*d* and placed on surface 70 to surround at least a portion of injured subject 80, still without the user(s) having to touch or otherwise interfere with the injured subject. Frame 110 may be unfolded/assembled by connecting at least the longitudinal members of longitudinal frame elements 130 to each other (e.g., as described above with respect to FIGS. 1B, 1C and 1D).

At stage 193, support connectors 144 may be removably connected to longitudinal frame elements 130.

At stage 194, elongated supports 142 may be threaded between injured subject 80 and surface 70 (e.g., through gaps formed between injured subject 80 and surface 70, for example, beneath knees, low back, neck, etc.) and connected, at stage 195, to longitudinal frame elements 130 by support connectors 144 (e.g., as described above with respect to FIGS. 1E and 1F). Legs 139 along longitudinal frame elements 130 may ease the threading of elongated supports 142 (e.g., as shown in FIG. 1I).

Optionally, at stage 196, support connectors 144 and the elongated supports 142 may be positioned along longitudinal frame elements 130 (e.g., as indicated by arrows 144*d* in FIG. 1I) to provide a desired support to injured subject 80. In some embodiments, the number elongated supports 142 and the respective number of support connectors 144 may be determined to meet the specific requirements on site. For example, a taller injured person may require use of additional one or more elongated supports 142, compared to a lower injured person.

Optionally, at stage 197 the length of transverse frame elements 120 (e.g., the actual width of the stretcher) may be adjusted (e.g., as indicated by arrows 128 in FIG. 1I and as described above with respect to FIGS. 1A and 1G). In this manner, the distance between longitudinal frame elements 130 may be adjusted to fit the width of injured subject 80 and/or to enhance passage of stretcher 100 in relatively narrow passageways (e.g., staircases, corridors, etc.).

At stage 198, stretcher 100 may be lifted (e.g., as indicated by arrows 60 in FIG. 1I), for example by two or more users, and be moved to a target location. Transverse frame elements 120 (and particularly elevated transverse frame elements 120) may serve, in some embodiments, as handles for lifting and carrying stretcher 100 (e.g., as shown in FIG.

1I). Curved first ends 144*a* and curved second ends 144*b* of support connectors 144 may enhance secured locking of respective supports 142 when stretcher 100 is being lifted, e.g., due to the weight of injured subject 80 applied thereon.

When arrived at the target location, stretcher 100 may be placed on a surface such as, for example, a hospital bed. Elongated supports 142 may be disconnected from support connectors 144 and pulled from beneath injured subject 80. Support connectors 144 may be disconnected from longitudinal frame elements 130 and frame 110 may be folded/disassembled into its folded/disassembled state 110*c*.

Reference is now made to FIGS. 2A, 2B, 2C, 2D and 2E, which are schematic illustrations of a more detailed aspect of a stretcher 200 including a partly foldable/decomposable frame 210, according to some embodiments of the invention.

Figure 2A:
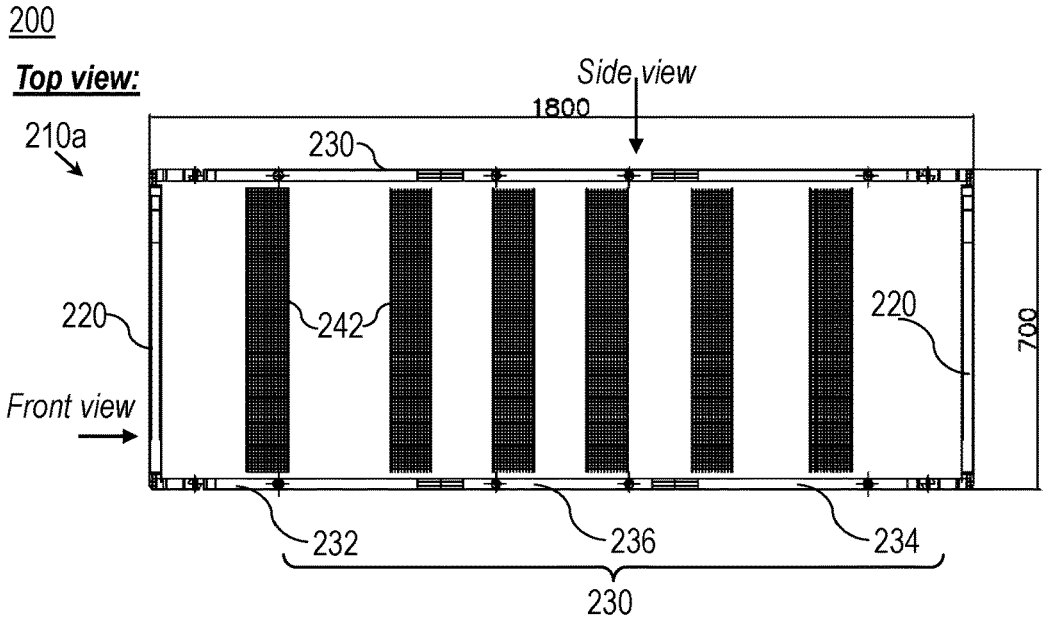
FIGS. 2A, 2B, 2C, 2D and 2E are schematic illustrations of a more detailed aspect of a stretcher including a partly foldable/decomposable frame, according to some embodiments of the invention.
Figure 2B:
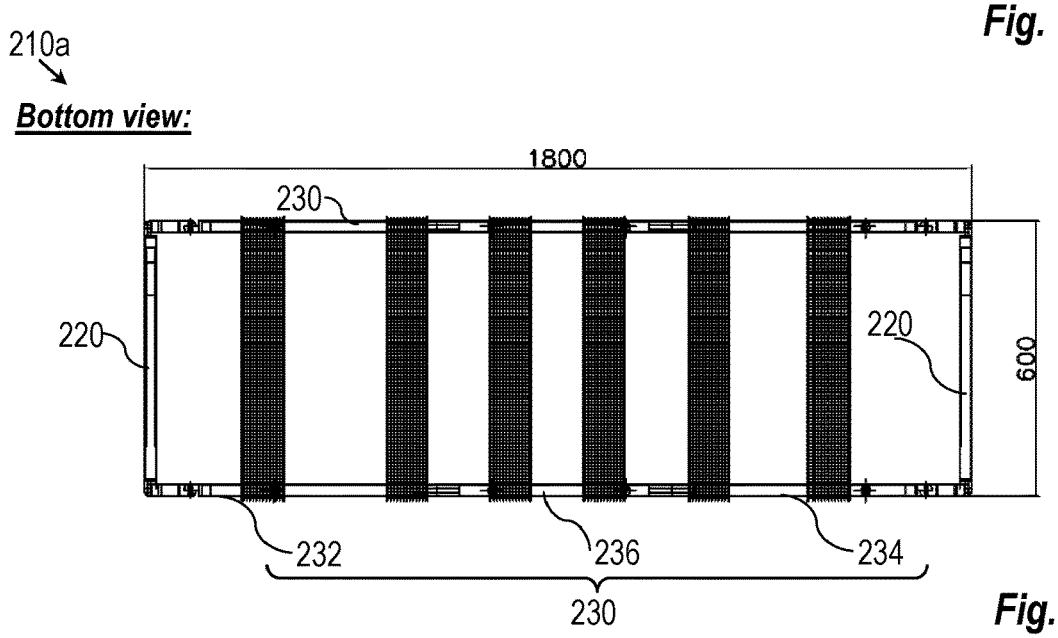
Figure 2C:
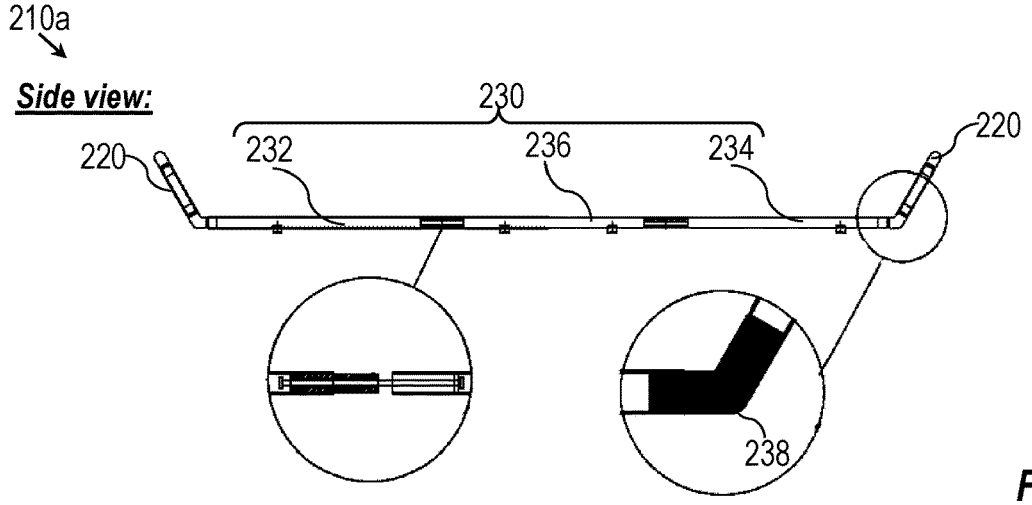
Figure 2D:
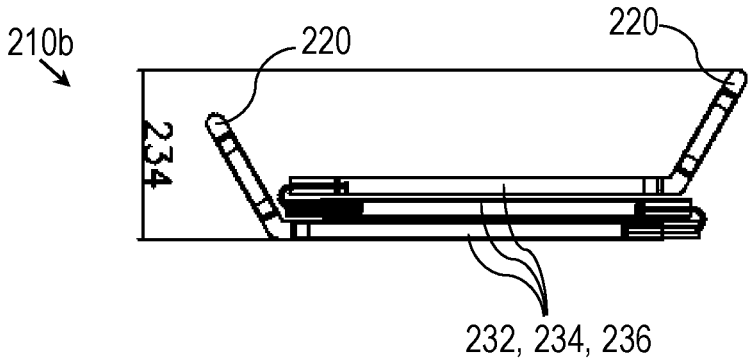
Figure 2E:
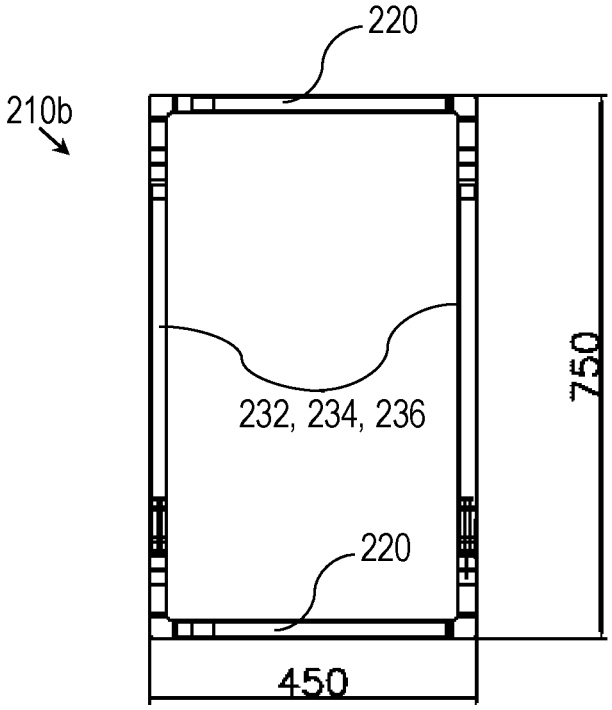

FIGS. 2A, 2B and 2C show stretch 200 with a frame 210 in its unfolded/assembled state 210*a*. FIGS. 2D and 2E show frame 210 in its folded/disassembled state 210*b*.

FIGS. 2A and 2B show top view and bottom view of stretch 200, respectively. FIG. 2C shows a side view of stretch 200. FIGS. 2D and 2E show a front view and a top view of frame 210, respectively.

According to some embodiments, stretcher 200 may include a foldable/decomposable frame 210. Frame 210 may include two transverse frame elements 220 and two longitudinal frame elements 230. Frame 210, transverse frame elements 220 and longitudinal frame elements 230 may be similar to, for example, frame 110, transverse frame elements 120 and longitudinal frame elements 130 described above with respect to FIGS. 1A, 1B, 1D, 1E, 1F, 1G and 1H.

Longitudinal frame elements 230 may each include, for example, a first longitudinal member 232, a second longitudinal member 234 and a third longitudinal member 236. For example, first longitudinal member 232, second longitudinal member 234 and third longitudinal member 236 may be similar to first longitudinal member 132, second longitudinal member 134 and third longitudinal member 136 described above with respect to FIGS. 1A, 1B, 1D, 1E, 1F, 1G and 1H.

First longitudinal member 232 and second longitudinal member 234 of each of longitudinal frame elements 230 may be rigidly connected to opposite transverse frame elements 220 using, for example, a die cast assembly 238 (e.g., as shown in FIG. 2C). Longitudinal members 232, 234, 236 may be removably connectable to each other at their respective ends (e.g., as described above with respect to FIGS. 1A, 1B, 1D, 1E, 1F, 1G and 1H).

In embodiments shown in FIGS. 2A, 2B and 2C, longitudinal frame elements 230 have a length of 1800 mm when frame 210 is in its unfolded/assembled state. In embodiments shown in FIGS. 2A, 2B and 2C, transverse frame elements 220 may be capable of extending and retracting in length (e.g., as described above with respect to FIG. 1A) to adjust a distance between opposite longitudinal frame elements 230, e.g., telescopically. For example, transverse frame elements 220 may be capable of extending and retracting between 700 and 600 mm as shown in FIGS. 2A and 2B, respectively. It is noted that longitudinal frame elements 230 and/or transverse frame elements 220 may have other dimensions as well.

Longitudinal members 232, 234, 236 of longitudinal frame elements 230 may be disconnected from each other, and frame 210 may be folded/disassembled into its folded/disassembled state 210*b* (e.g., as shown in FIGS. 2D and 2E). For example, in embodiments shown in FIGS. 2D and 2E, frame 210 may have 750 mm in length, 450 mm in width and 234 mm in height when frame 210 is in its folded/disassembled state 210*b*.

According to some embodiments, stretcher 200 may include multiple elongated supports 242. Elongated supports 242 may be removably connectable between opposite longitudinal frame elements 230 using, for example, support connectors (e.g., as shown in FIGS. 2A and 2B). The support connectors are not shown in FIGS. 2A and 2B for sake of clarity. Elongated supports 242 and/or the support connectors may be similar to elongated supports 142 and support connectors 144 of support assemblies 140 described above with respect to FIGS. 1A and 1E-1H.

Reference is now made to FIGS. 3A, 3B, 3C, 3D and 3E, which are schematic illustrations of a more detailed aspect of a stretcher 300 including a foldable/decomposable frame 310, according to some embodiments of the invention.

Figure 3A:
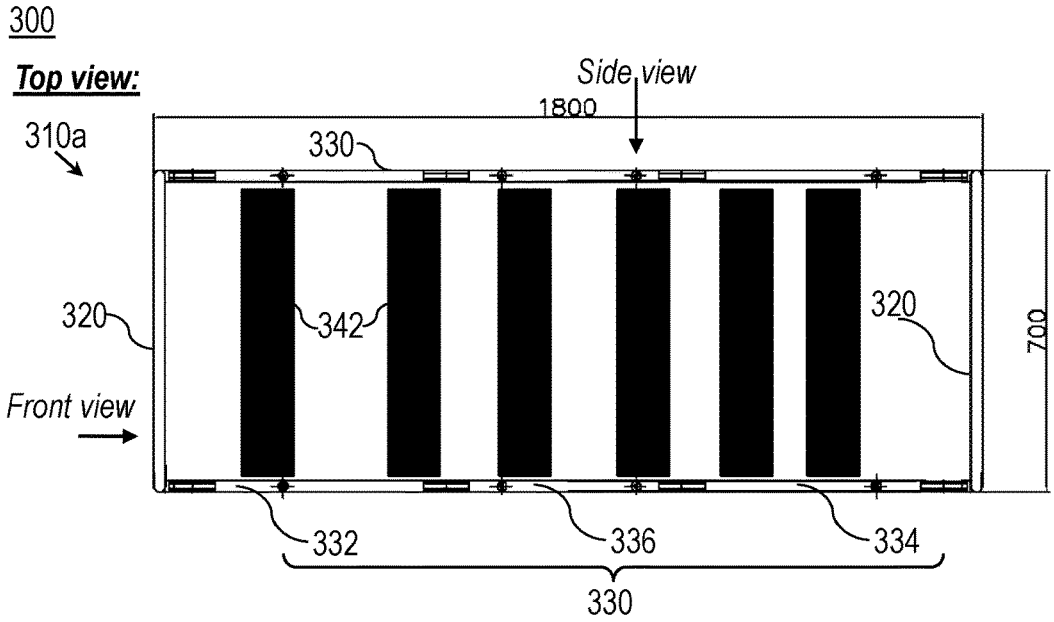
FIGS. 3A, 3B, 3C, 3D and 3E are schematic illustrations of a more detailed aspect of a stretcher including a foldable/decomposable frame, according to some embodiments of the invention.
Figure 3B:
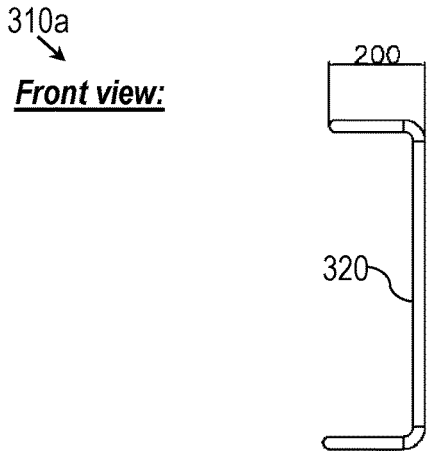
Figure 3C:
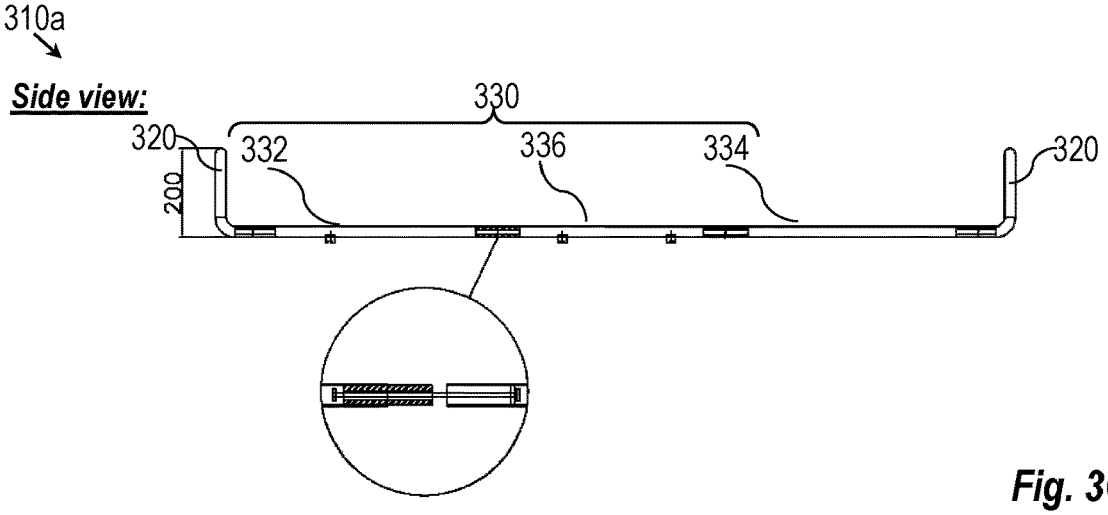

FIGS. 3A, 3B and 3C show stretch 300 with a frame 310 in its unfolded/assembled state 310*a*. FIGS. 2D and 2E show frame 310 in its folded/disassembled state 310*b*.

Figure 3D:
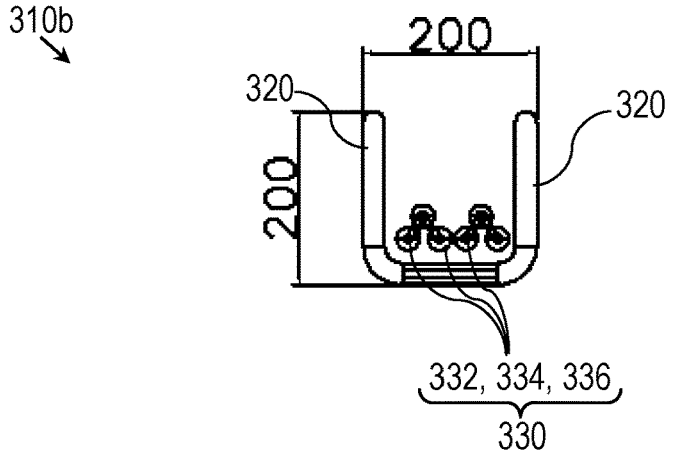
Figure 3E:
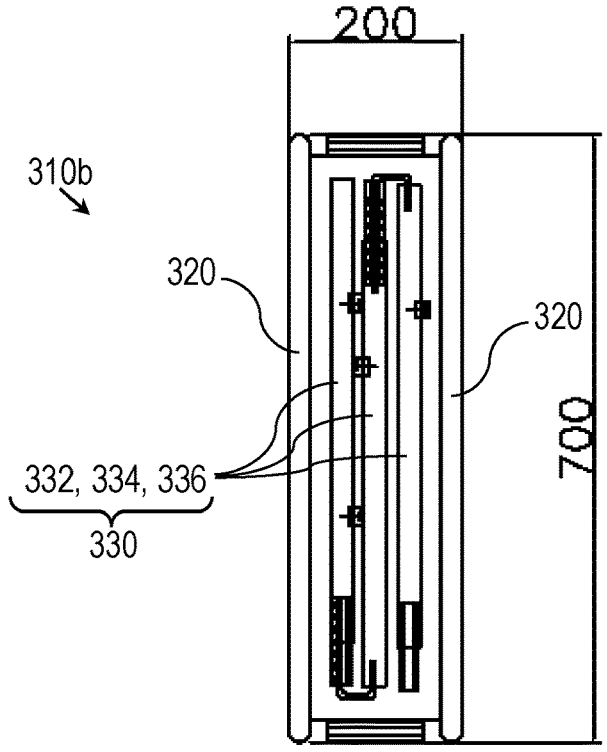

FIGS. 3A, 3B and 3C show a top view, a front view and a side view of stretch 200, respectively. FIGS. 3D and 3E show a front view and a top view of frame 310, respectively.

According to some embodiments, stretcher 300 may include a foldable/decomposable frame 310. Frame 310 may include two transverse frame elements 320 and two longitudinal frame elements 330. Frame 310, transverse frame elements 320 and longitudinal frame elements 330 may be similar to, for example, frame 110, transverse frame elements 120 and longitudinal frame elements 130 described above with respect to FIGS. 1A, 1B, 1C, 1D, 1E, 1F, 1G and 1H.

Longitudinal frame elements 330 may each include, for example, a first longitudinal member 332, a second longitudinal member 334 and a third longitudinal member 336. For example, first longitudinal member 332, second longitudinal member 334 and third longitudinal member 336 may be similar to first longitudinal member 132, second longitudinal member 134 and third longitudinal member 136 described above with respect to FIGS. 1A, 1B, 1D, 1E, 1F, 1G and 1H.

First longitudinal member 332 and second longitudinal member 334 of each of longitudinal frame elements 330 may be removably connectable to opposite transverse frame elements 320 (e.g., as described above with respect to FIG. 1C). Longitudinal members 332, 334, 336 may be removably connectable to each other at their respective ends (e.g., as described above with respect to FIGS. 1A, 1B, 1D, 1E, 1F, 1G and 1H).

In embodiments shown in FIGS. 3A, 3B and 3C, longitudinal frame elements 330 have a length of 1800 mm when frame 310 is in its unfolded/assembled state. In embodiments shown in FIGS. 3A, 3B and 3C, transverse frame elements 320 may have a height of 220 mm. It is noted that longitudinal frame elements 330 and/or transverse frame elements 320 may have other dimensions as well.

Longitudinal members 332, 334, 336 of longitudinal frame elements 330 may be disconnected from each other and from transverse frame elements 320, and frame 310 may be folded/disassembled into its folded/disassembled state 310*b* (e.g., as shown in FIGS. 3D and 3E). For example, in embodiments shown in FIGS. 3D and 3E, frame 310 may be of 700 mm in length, 200 mm in width and 200 mm in height when frame 310 is in its folded/disassembled state 310*b*.

According to some embodiments, stretcher 300 may include multiple elongated supports 342. Elongated supports 342 may be removably connectable between opposite longitudinal frame elements 330 using, for example, support connectors (e.g., as shown in FIG. 3A). The support connectors are not shown in FIG. 3A for sake of clarity. Elongated supports 342 and/or the support connectors may be similar to elongated supports 142 and support connectors 144 of support assemblies 140 described above with respect to FIGS. 1A and 1E-1H.

Figure 4:
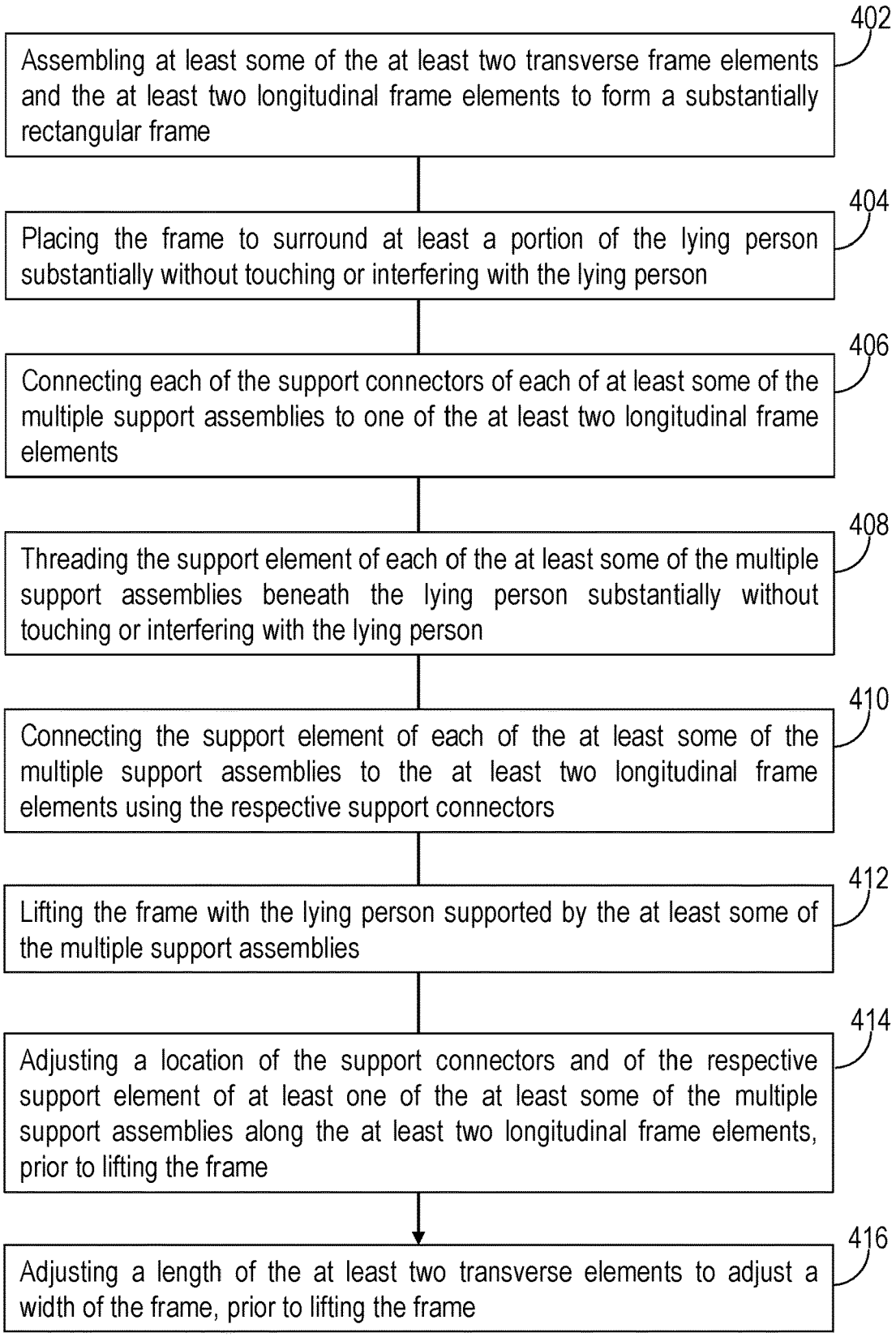
FIG. 4 is a flowchart of a method of loading a lying person on a stretcher, according to some embodiments of the invention.

Reference is now made to FIG. 4, which is a flowchart of a method of loading a lying person on a stretcher, according to some embodiments of the invention.

It is noted that the method is not limited to the flowcharts illustrated in FIG. 4 and to the corresponding description. For example, in various embodiments, the method needs not move through each illustrated box or stage, or in exactly the same order as illustrated and described.

According to some embodiments, the stretcher may include at least two transverse frame elements, at least two longitudinal frame elements and multiple support assemblies, each comprising an elongated support and two support connectors. For example, the stretcher may be any of the stretchers described above with respect to FIGS. 1A, 1B, 1C, 1D, 1E, 1F, 1G and 1H, FIGS. 2A, 2B, 2C, 2D and 2E and FIGS. 3A, 3B, 3C, 3D and 3E.

Some embodiments may include assembling at least some of the at least two transverse frame elements and the at least two longitudinal frame elements to form a substantially rectangular frame (stage 402), for example, as described above with respect to FIGS., 1B, 1C, 1D and 1I.

Some embodiments may include placing the frame to surround at least a portion of the person lying down substantially without touching or interfering with the person (stage 404). For example, as described above with respect to FIG. 1I.

Some embodiments may include connecting each of the support connectors of each of at least some of the multiple support assemblies to one of the at least two longitudinal frame elements (stage 406). For example, as described above with respect to FIGS. 1E, 1F and 1I.

Some embodiments may include threading the support element of each of the at least some of the multiple support assemblies beneath the lying person (e.g., between the person lying down and a surface) substantially without touching or interfering with the person (stage 408). For example, as described above with respect to FIG. 1I.

Some embodiments may include connecting the support element of each of the at least some of the multiple support assemblies to the at least two longitudinal frame elements using the respective support connectors (stage 410). For example, as described above with respect to FIGS. 1E, 1F and 1I.

Some embodiments may include lifting the frame with the person lying down supported by the at least some of the multiple support assemblies (stage 412). For example, as described above with respect to FIG. 1I.

Some embodiments may include adjusting a location of the support connectors and of the respective support element of at least one of the at least some of the multiple support assemblies along the at least two longitudinal frame elements, prior to lifting the frame (stage 414). For example, as described above with respect to FIGS. 1E, 1F and 1I.

Some embodiments may include adjusting a length of the at least two transverse elements to adjust a width of the frame, prior to lifting the frame (stage 416). For example, as described above with respect to FIGS. 1A and 1I.

Advantageously, the disclosed stretcher may enable loading/unloading of an injured subject on/from the stretcher without a physical contact between one or more users and the injured subject. The frame of the stretcher may be designed to be folded in a compact way and the support assemblies of the stretcher may be removably connectable to the frame. In this manner, the stretcher may be compactly packed in, for example, a backpack, and significantly reduce a total space being occupied when not in use, as compared to, for example, prior art stretcher. Moreover, the stretcher may be easily and intuitively assembled in a short time that does not exceed, for example, 20-50 seconds.

Furthermore, the supporting assemblies may be movably and rotatably connected to the frame of the stretcher. As a result, each of the supporting assemblies may move in a different manner as compared to other supporting assemblies when, for example, the injured subject is loaded thereon. In this manner, the stretcher may provide enhanced measure of cushioning to the injured subject during carrying thereof by, for example, considerate selection of the location of each elongated support underneath the carried person. This is contrast to prior art stretchers, some of which use rigid boards as supports and as a result any movement of the prior art stretchers affects equally to any portion of the injured subject. Other prior art may use flexible sheet stretched on the stretcher's frame, yet the form that the sheet accepts when a person is loaded depends on the specific feature of the sheet with no specific consideration to the personal feature of the carried person.

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination. Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A stretcher comprising:

a foldable/decomposable frame comprising:

two transverse frame elements, and at least two longitudinal frame elements including first and second longitudinal frame elements, each comprising at least a first longitudinal member and at least a second longitudinal member perpendicularly connectable at their respective first ends to the two transverse frame elements and removably connectable to each other at their second ends; and multiple support assemblies, each comprising:

an elongated support having first and second end portions, and first and second support connectors removably connectable at a first end thereof to the first and second longitudinal frame elements and removably connectable at a second end thereof to the first and second end portions of the elongated support, wherein the first end of each support connector is curved towards the second end and has a first radius of curvature, and the second end of each support connector is curved towards the first end and has a second radius of curvature, and wherein the elongated support of each of the support assemblies includes apertures at the first and second end portions and each aperture is adapted to receive the second end of the first and second support connectors of the respective support assembly.

2. The stretcher of claim 1, wherein each of the at least two longitudinal frame elements further comprises at least a third longitudinal member removably connectable at its first end to the second end of the first longitudinal member and removably connectable at its second end to the second end of the second longitudinal member.

3. The stretcher of claim 1, wherein the first longitudinal member and the second longitudinal member are removably connectable at their first ends to the two transverse frame elements.

4. The stretcher of claim 1, wherein each of the two transverse frame elements comprises:

a first transverse member, and a second transverse member, and wherein the first transverse member is adapted to tightly and movably receive the second transverse member and to enable movement of the second transverse member within the first transverse member when a desired force is applied thereto to thereby adjust a length of the transverse frame element.

5. The stretcher of claim 1, wherein at least one of the two transverse frame elements comprises two bars, each perpendicularly protruding from one of ends of the respective transverse frame element.

6. The stretcher of claim 5, wherein the at least one of the two transverse frame elements is aligned at a predetermined transverse frame element angle with respect to a plane defined by the at least two longitudinal frame elements when the foldable/decomposable frame is in its unfolded/assembled state, and wherein the predetermined transverse frame element angle ranges between 0° and 90°.

7. The stretcher of claim 1, wherein the first radius of curvature is determined based on a radius of the at least two longitudinal frame elements to enable at least one of:

a tight and removable connection of the first end of each of the first and second support connectors of each of the support assemblies to the at least two longitudinal frame elements;

a rotation of the first end of each of the first and second support connectors of each of the support assemblies about the at least two longitudinal frame elements; and a movement of the first end of each of the first and second support connectors of each of the support assemblies along the at least two longitudinal frame elements.

8. The stretcher of claim 1, wherein at least one of the first longitudinal member and the second longitudinal member of each of the at least two longitudinal frame elements comprises at least one leg dimensioned to elevate the foldable/decomposable frame above a surface by a predetermined height when the foldable/decomposable frame is in its unfolded/assembled state and the foldable/decomposable frame is disposed on the surface.

9. The stretcher of claim 1, further comprising a secure band, wherein each of the first and second support connectors of at least one of the support assemblies comprises a secure band connector at the respective first end, the secure band connector being adapted to removably connect the secure band to the respective support connector.

10. A method of loading a lying person on a stretcher, the stretcher comprising at least two transverse frame elements, at least two longitudinal frame elements, and multiple support assemblies, each comprising an elongated support and two support connectors, the method comprising:

assembling at least some of the at least two transverse frame elements and the at least two longitudinal frame elements to form a substantially rectangular frame, wherein a first end of each support connector is curved towards a second end of each support connector and has a first radius of curvature, the second end of each support connector is curved towards the first end of each support connector and has a second radius of curvature, and the elongated support of each of the support assemblies includes apertures at first and second end portions and each aperture is adapted to receive the second end of each support connector of the respective support assembly;

placing the substantially rectangular frame to surround at least a portion of the lying person substantially without touching or interfering with the lying person;

connecting each of the support connectors of each of at least some of the multiple support assemblies to one of the at least two longitudinal frame elements;

threading the elongated support of each of the multiple support assemblies beneath the lying person substantially without touching or interfering with the lying person;

connecting the elongated support of each of the multiple support assemblies to the at least two longitudinal frame elements using the respective support connectors; and lifting the substantially rectangular frame with the lying person supported by the at least some of the multiple support assemblies.

11. The method of claim 10, further comprising adjusting a location of the two support connectors and of the respective elongated support of at least one of the multiple support assemblies along the at least two longitudinal frame elements, prior to lifting the substantially rectangular frame.

12. The method of claim 10, further comprising adjusting a length of the at least two transverse frame elements to adjust a width of the substantially rectangular frame, prior to lifting the substantially rectangular frame.

* * * * *